US006186609B1

(12) United States Patent
Huang et al.

(10) Patent No.: US 6,186,609 B1
(45) Date of Patent: Feb. 13, 2001

(54) APPARATUS AND METHOD FOR DISPENSING INK ON AN OBJECT

(75) Inventors: Kuo-Chen Huang, Chu-Tong; Hsiao-Tzu Wang, Hsin-Chu, both of (TW)

(73) Assignee: Taiwan Semiconductor Manufacturing Co., Ltd, Hsin Chu (TW)

( * ) Notice: Under 35 U.S.C. 154(b), the term of this patent shall be extended for 0 days.

(21) Appl. No.: 08/958,028

(22) Filed: Oct. 27, 1997

(51) Int. Cl.[7] ..... B41J 3/00; B41J 25/308
(52) U.S. Cl. ..... 347/2; 347/8
(58) Field of Search ..... 346/29, 33 F; 347/2, 8; 324/759, 765; 200/86.5; 358/1.3

(56) References Cited

U.S. PATENT DOCUMENTS 3,968,498 * 7/1976 Uchiyama ..... 347/2
4,952,880 * 8/1990 Clinton ..... 324/544
5,414,452 * 5/1995 Accatino et al. ..... 347/7
5,455,605 * 10/1995 David et al. ..... 346/33 F

* cited by examiner

*Primary Examiner*—Fred L Braun
(74) *Attorney, Agent, or Firm*—Tung & Associates

(57) ABSTRACT

A method and apparatus for dispensing ink on an object by utilizing an ink dispensing device mounted on a guide rail system so that the device can be freely moved two-dimensionally for dispensing ink at any desirable location on the surface of an object. The activation of the ink dispensing device can be advantageously controlled by either a foot operated switch, a hand operated switch or a voice operated switch. A counter may optionally be used on the apparatus such that the number of times the activation device was activated can be accurately recorded as an indication of defect counts or any other counts.

15 Claims, 1 Drawing Sheet

APPARATUS AND METHOD FOR DISPENSING INK ON AN OBJECT

FIELD OF THE INVENTION

The present invention generally relates to an apparatus and a method for dispensing ink on an object and more particularly, relates to an apparatus and method for marking defective dies on a semiconductor wafer by utilizing an ink dispensing device slidably mounted on horizontal and transverse guide rails.

BACKGROUND OF THE INVENTION

In the fabrication process for semiconductor devices, numerous processing steps, i.e., as many as several hundred, must be carried out on a semi-conducting wafer to form device circuits. Of the numerous processing steps, photolithographic, etching, deposition, planarization and passivation steps are the most frequently performed on the wafer. After circuits are completely formed on the semiconductor device, the wafer must be tested to verify the proper function of the circuits before it is sliced into separate dies and packaged into chips. This type of testing is sometimes known as a known-good-die test (or KGD test) which is an important step in the total semiconductor manufacturing process for controlling the quality and reliability of the devices fabricated.

A known-good-die test can be carried out in many commercially available testing machines that are specifically designed for such purpose. For instance, one such tester is a Trillium® tester model Micro-Master II which is supplied by the LTX Corporation of San Jose, Calif. The Trillium® tester is normally used to electrically test semiconductor dies on a wafer to determine the individual die performance and subsequently, the wafer yields. When a die fails an electrical test, the testing machine places a round ink spot on the die so that the defective die can be readily identified and rejected in later chip handling process, i.e., wafer slicing and die sorting operations. After the slicing operation, the defective dies which have the ink spots are separated from the chips that have passed the electrical test.

While the Trillium®-type testing machines are effective in performing electrical tests to verify the proper functioning of the dies, certain other defects of the dies cannot be readily detected by the Trillium® tester. For instance, there may have been a defective passivation process which leads to dies that are insufficiently covered by an insulating layer as indicated by void formations. There may also be defects such as bonding pads that are defectively formed such that the die cannot be wire bounded in a later packaging process. These types of defects can be readily discovered by a visual examination of the dies by an operator looking at the wafer surface before the slicing operation during which the dies are severed into individual chips. When the defective dies are discovered during a visual examination, an ink mark must be manually placed on each of the defective dies by hand. Such manual inking process requires the use of a hand tool by an operator based on a die map for locating the defective dies and marking them with an ink spot.

Other defects for which the manual inking process must be carried out by using a hand tool include when the probe mark is out of specification, when the wafer surface is scratched, when the ink dot placed by the tester is cracked, smeared, splotched, diffused, when the ink formed a hollow ink dot with a void or when the ink dot size is out of specification.

The manual inking process performed by a quality inspector by using a hand tool can be defective in itself and thus causing various quality problems. For instance, the sizes of the ink dots are not the same when they are placed on defective dies by a human hand. Furthermore, the manual inking process carried out by using a hand tool also consumes unnecessary manpower and leads to longer cycle times. After the defective dies are manually inked by a hand tool, the wafer is sent to a bake oven for baking and drying. The manually placed ink dot frequently cracks after the baking process due to inadequate inking process or poor temperature control of the baking oven. Moreover, the manual inking process by a hand tool frequently requires a re-cleaning of the wafer surface or a re-inking of the defective dies.

It is therefore an object of the present invention to provide an apparatus for dispensing ink on an object that does not have the drawbacks or shortcomings of the conventional method of dispensing ink by a hand tool.

It is another object of the present invention to provide an apparatus for dispensing ink on an object by using an ink dispensing device slidingly supported by a guide rail system such that the ink dispensing device can be moved in both the X and Y directions on a guide rail system for placing ink dots on an object.

It is a further object of the present invention to provide an apparatus for dispensing ink on an object which includes an ink dispensing device mounted on a guide rail system for conveniently moving the ink dispensing device in the X and Y directions and then activating the dispensing of ink by an activation means.

It is another further object of the present invention to provide an apparatus for marking defective dies on a semiconductor wafer by using an ink dispensing device which is mounted on a guide rail system for two-dimensional movements of the dispensing device such that a defective die can be readily identified and located under the ink dispensing device.

It is still another object of the present invention to provide an apparatus for marking defective dies on a semiconductor wafer which includes an ink dispensing device mounted in a guide rail system for two-dimensional movement of the dispensing device and an activation device of a foot operated switch for controlling a pre-set flow of ink through the ink dispensing device.

It is yet another object of the present invention to provide an apparatus for marking defective dies on a semiconductor wafer by utilizing an ink dispensing device mounted on a guide rail system for two-dimensional movements of the dispensing device, an activation device for controlling the flow of ink through the dispensing device and a counter device for counting the number of times the activation device is activated.

It is still another further object of the present invention to provide a method for dispensing ink marks on a wafer surface by slidably mounting an ink dispensing device on a guide rail system for two-dimensional movements of the device and by activating the ink dispensing device for dispensing an ink drop after the device is moved to a predetermined location over a defective die.

It is yet another further object of the present invention to provide a method for dispensing ink marks on a semiconductor wafer surface by slidably mounting an ink dispensing device on a guide rail system for two-dimensional movements of the dispensing device and by calibrating a height of the ink dispensing device with a calibration stand prior to the start of each wafer marking process.

SUMMARY OF THE INVENTION

In accordance with the present invention, an apparatus and a method for dispensing ink on an object are provided in which an ink dispensing device is slidably mounted on a guide rail system for two-dimensional movements and an activation device is activated so that ink can be dispensed from the ink dispensing device onto the surface of an object.

In a preferred embodiment, an apparatus for dispensing ink on an object is provided which includes a base for holding an object in a horizontal position, an ink dispensing device which includes a ink reservoir and an ink dispensing head, a first guide rail for slidingly supporting the ink dispensing device and allowing the ink dispensing device to slide on the first guide rail in a first direction wherein the first guide rail has two ends each supported by a mounting block, a pair of second guide rails mounted spaced apart each adapted for slidably mounting one of the mounting blocks thereto such that the first guide rail moves on the pair of second guide rails in a second direction perpendicular to the first direction, and an activation device for controlling a pre-set flow of ink through the ink dispensing device.

In another preferred embodiment, the present invention discloses an apparatus for marking defective dies on a semiconductor wafer which includes a holder for holding a wafer in a horizontal position, an ink dispensing device which includes an ink reservoir and an ink dispensing head, a first guide rail for slidingly supporting the ink dispensing device and allowing the ink dispensing device to slide on the first guide rail in a first direction wherein the first guide rail has two ends, each end supported by a mounting block, a pair of second guide rails mounted spaced apart, each of the second guide rails adapted for slidably mounting one of the mounting blocks thereto such that the first guide rail moves on the pair of second guide rails in a second direction perpendicular to the first direction, an activation device for controlling a pre-set flow of ink through the ink dispensing device, and a counter device for counting the number of times the activation device is activated.

The present invention is further directed to a method for dispensing ink marks on a wafer surface including the operating steps of first providing a wafer stage for holding a wafer in a horizontal position, then slidably mounting an ink dispensing device which includes an ink reservoir and an ink dispensing head onto a first guide rail such that the ink dispensing device is capable of sliding motion in a first direction, the first guide rail has two ends each supported by a mounting block, then slidably mounting the mounting blocks to a pair of second guide rails such that the first guide rail slides on the pair of second guide rails in a second direction, and then activating the ink dispensing head to dispense an ink drop when the ink dispensing device is moved to a predetermined position on the wafer surface.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses an apparatus for marking defective dies on a semiconductor wafer by mounting an ink dispensing device on a guide rail system such that the device is capable of two-dimensional movements over the surface of the wafer and capable of being activated by an activation device for depositing an ink drop on a defective die when the dispensing device is moved to a predetermined position over the wafer surface. The present invention further discloses a method for dispensing ink marks on a semiconductor wafer surface by slidably mounting an ink dispensing device on a guide rail system such that the device moves two-dimensionally over a wafer surface and by activating the device to dispense an ink drop on a defective die when the dispensing device is positioned over such die.

Figure 1:
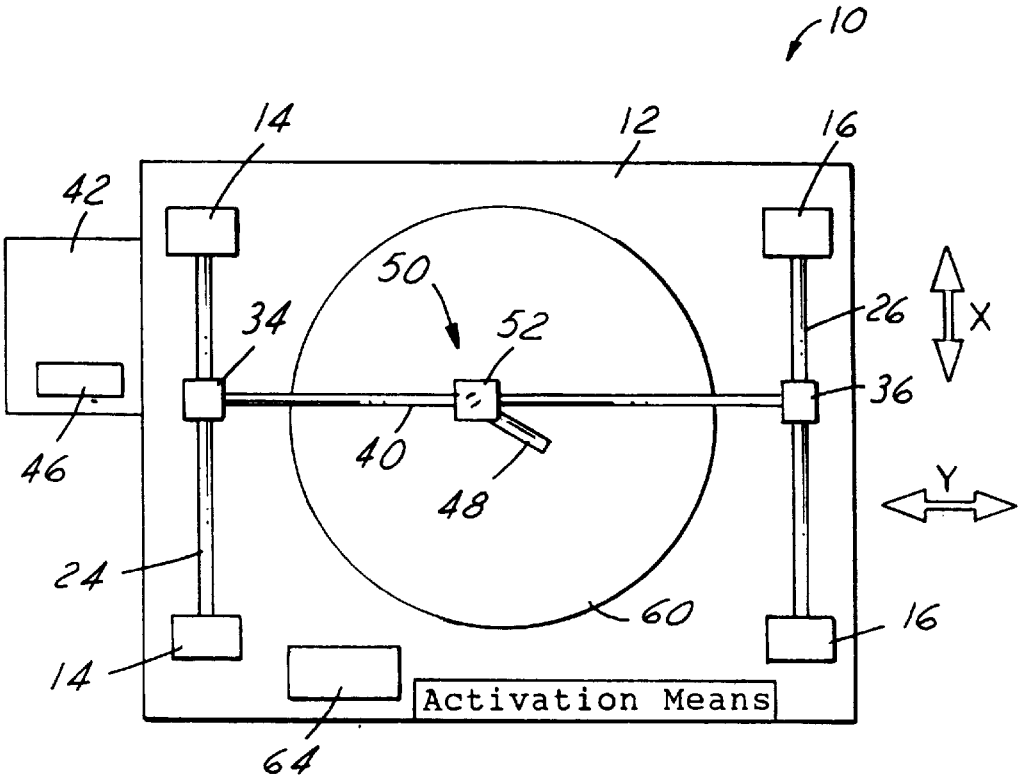
FIG. 1 is a plane view of the present invention device illustrating the ink dispensing device and the guide rail system.

Referring now to FIG. 1, wherein a plane view of a present invention apparatus 10 for dispensing ink marks on a semiconductor wafer is shown. The apparatus 10 is built on a support base 12 (also shown in FIG. 2). Onto the support base 12, two pairs of mounting supports 14 and 16 are provided which are fixed to the support base 12. Guide rails 24 and 26 are then provided with each of its ends mounted in the pairs of mounting supports 14 and 16. The guide rails 24 and 26 are rods having a circular cross-section and a smooth surface such that a pair of mounting blocks 34 and 36 may be attached thereto for allowing a sliding motion of blocks 34 and 36 on the guide rails 24 and 26, respectively. It should be noted that ball bearings (not shown) are preferably used at the interface between mounting blocks 34, 36 and the guide rails 24 and 26 to facilitate the sliding motion of the blocks.

The mounting blocks 34 and 36 are connected by a guide rail 40 which may be conveniently manufactured of the same type of rods used for guide rails 24 and 26. An ink dispensing device 50 is then slidably mounted to the guide rail 40. The ink dispensing device is constructed of an ink reservoir 52 and an ink dispensing head 54. It is desirable that a ball bearing is used in mounting the ink dispensing device 50 to the guide rail 40 such that a smooth sliding motion of device 50 on the guide rail 40 is possible. The ink reservoir 52 can be constructed of any suitable material that can hold an adequate amount of ink to allow ink to flow smoothly out of the ink dispensing head 54. An activation device (not shown) such as a solenoid valve may be utilized which is mounted to the ink reservoir 52 to allow a passage to the ink dispensing head 54 to be opened or closed. An electrical signal can be fed to the activation device from a process controller which is in turn controlled by a switch such as a foot activated switch, a hand activated switch or a voice activated switch (not shown). A power supply 42 is provided for supplying power to the activation device for the opening or closing of the ink flow to the dispensing head 54. A digital counter 46 is also provided and mounted to the power supply such that it counts the number of times the activation device has been activated. This provides a reliable count of the number of defective dies on the semiconductor wafer 60. The digital counter may be reset each time a wafer is placed onto the support base 12.

The ink dispensing device 50 is further equipped with a handle 48 affixed to the device such that it can be conveniently moved either in the Y direction along guide rail 40 or in the X direction along guide rails 24 and 26. In practical use, the ink dispensing device 50 can be conveniently moved simultaneously in the X and Y directions by guiding the device with one hand by handle 48 in both the X and Y directions simultaneously. This allows the convenient positioning of the ink dispensing head 54 over a defective die on wafer 60 by an operator. A wafer map is frequently used to identify the locations of defective dies as provided by a data sheet or by visual examination of the wafer surface by tic operator. The ink dispensing means may also be driven by a control means and drive means on a first guide rail and mounting blocks on a pair of second guide rails such that ink may be dispensed in an automated fashion at any position with an XY area. The control means may be a microprocessor controller.

A calibration stand 64 may optionally be provided on a top surface 66 of the support base 12. The calibration stand 64 is fixed to the support base 12 by mechanical means. The calibration stand 64 is essentially a metal block that has a predetermined thickness approximate the height of the top surface of wafer 60 such that the ink dispensing head 54 can be calibrated by the top surface 68 of the calibration stand 64 prior to the inking operation. The calibration can be performed by placing the ink dispensing head 54 on the top surface 68, and then adjusting the position of the ink dispensing head by its mounting bracket on the ink reservoir 52. The calibration allows a precise distance to be maintained between the tip of the dispensing head 54 and the top surface 72 of wafer 60. A minimum distance between the ink dispensing head 54 and the top surface 72 of wafer 60 is necessary so that the ink dispensing head 54 does not actually touch and thus scratch the surface of the wafer. The dimension of the ink dot placed on the wafer surface is normally between about 400 $\mu$m and about 1,200 $\mu$m.

The benefits that can be achieved by the present invention ink dispensing apparatus are several, for instance, the same ink dot size can be maintained when ink is dispensed on different dies or even different wafers, no re-cleaning of the wafer surface is required, no re-inking of the defective dies is necessary, a low rejection rate of the dies after the dies are severed into chips, a shorter cycle time since the inking process can be carried out faster than the process of using a hand tool.

Figure 2:
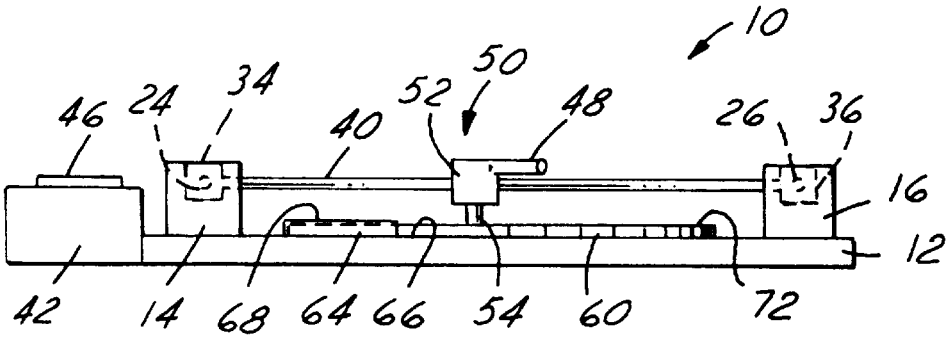
FIG. 2 is a front view of the present invention apparatus illustrating the ink reservoir, the ink dispensing head and the guide rail system.

The advantages and the benefits of the present invention apparatus and method for marking defective dies with a ink dispensing device have been amply demonstrated by the above descriptions and the appended drawings FIGS. 1 and 2. However, it should be noted that the present invention apparatus can be used for the general purpose of dispensing ink marks on any surfaces or on any objects. The use of the present invention apparatus is therefore in no way limited to the surface of a semiconductor wafer.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

What is claimed is:

1. An apparatus for dispensing ink on an object comprising:

a stage for holding an object in a horizontal position, an ink dispensing means comprising an ink reservoir and an ink dispensing head, a first guide rail for slidably supporting said ink dispensing means and allowing said ink dispensing means to slide on said first guide rail in a first direction, said first guide rail having two ends each being supported by a mounting block, a pair of second guide rails mounted spaced apart, each of said second guide rails adapted for slidably mounting one of said mounting blocks thereto such that said first guide rail moves relative to said pair of second guide rails in a second direction perpendicular to said first direction, an activation means for controlling a preset flow of ink through said ink dispensing means, and a calibration stand for setting a height for said ink dispensing head.

2. An apparatus according to claim 1 further comprising a counter means for counting the number of times said activation means been activated.

3. An apparatus according to claim 2, wherein said counter means is a resettable digital counter.

4. An apparatus according to claim 1, wherein said ink dispensing means is capable of dispensing ink in a circular-shaped dot.

5. An apparatus according to claim 1, wherein said pair of second guide rails each having a length X mounted spaced apart by a distance of approximately Y, the length of said first guide rail such that said ink dispensing means is capable of dispensing ink at any position within an XY area.

6. An apparatus according to claim 5 further comprising a control means and drive means for driving said ink dispensing means on said first guide rail and said mounting blocks on said pair of second guide rails such that ink may be dispensed in an automated fashion at any position within said XY area.

7. An apparatus according to claim 1, wherein said mounting blocks are each equipped with bearing means for facilitating sliding motion on said pair of second guide rails.

8. An apparatus according to claim 1, wherein said ink dispensing means is further equipped with bearing means adapted for sliding engagement with said first guide rail.

9. An apparatus according to claim 1, wherein said activation means comprises a foot activated switch, a hand activated switch or a voice activated switch.

10. An apparatus according to claim 1, wherein said activation means comprises a foot pedal.

11. A method for dispensing ink marks on a wafer surface comprising the steps of:

providing a base for holding a wafer in a horizontal position, slidably mounting an ink dispensing means comprising an ink reservoir and an ink dispensing head onto a first guide rail such that said ink dispensing means is capable of sliding in a first direction, said first guide rail having two ends each supported by a mounting block, slidably mounting said mounting blocks onto a pair of second guide rails such that said first guide rail slides on said pair of second guide rails in a second direction, calibrating a height of said ink dispensing head with a calibration stand, and activating said ink dispensing head to dispense an ink drop when said ink dispensing means is moved to a predetermined location on said wafer surface.

12. A method according to claim 11 further comprising the step of providing first bearing means on said ink dispensing means to facilitate sliding motion of said ink dispensing means on said first guide rail; and providing second bearing means on said mounting blocks to facilitate sliding motion of said mounting blocks on said second guide rail.

13. A method according to claim 11, wherein said pair of said second guide rails each having a length X and are mounted spaced apart by a distance of approximately Y, the length of said first guide rail such that said ink dispensing means is capable of dispensing ink at any position within an XY area.

14. A method according to claim 11 further comprising the step of providing a counter means for counting the number of times said ink dispensing head is activated.

15. A method according to claim 11 further comprising the step of providing bearing means to said mounting blocks and said ink dispensing means to facilitate sliding motion on said pair of said second guide rails and on said first guide rail, respectively.

* * * * *